US009267304B2

(12) United States Patent
Elworthy

(10) Patent No.: US 9,267,304 B2
(45) Date of Patent: Feb. 23, 2016

(54) MULTI-SEASONAL FIELD DEVICE ENCLOSURE

(71) Applicant: Silverline Services, LLC, Windsor, CO (US)

(72) Inventor: Shawn Elworthy, Windsor, CO (US)

(73) Assignee: SILVERLINE SERVICES, LLC, Windsor, CO (US)

( * ) Notice: Subject to any disclaimer, the term of this patent is extended or adjusted under 35 U.S.C. 154(b) by 0 days.

(21) Appl. No.: 14/334,899

(22) Filed: Jul. 18, 2014

(65) Prior Publication Data

US 2016/0017624 A1 Jan. 21, 2016

(51) Int. Cl.

| | |
|---|---|
| ***E04H 5/02*** | (2006.01) |
| ***E04H 9/16*** | (2006.01) |
| ***E04H 15/34*** | (2006.01) |
| ***E04H 15/54*** | (2006.01) |

(52) U.S. Cl.

CPC .. *E04H 5/02* (2013.01); *E04H 9/16* (2013.01); *E04H 15/34* (2013.01); *E04H 15/54* (2013.01)

(58) Field of Classification Search

CPC .... F24F 1/58; A61H 2202/122; E04H 1/1238
USPC ..... 135/97, 900, 119, 120.3, 120.4, 905; 52/63

See application file for complete search history.

(56) References Cited

U.S. PATENT DOCUMENTS

| | | | | | |
|---|---|---|---|---|---|
| 2,258,084 | A * | 10/1941 | Baker | 135/97 |
| 2,880,741 | A * | 4/1959 | McGrand | 135/97 |
| 3,320,996 | A * | 5/1967 | Singer | 150/165 |
| 3,593,997 | A * | 7/1971 | Boehner | 473/421 |
| 3,885,362 | A * | 5/1975 | Pollock | 52/126.7 |
| 4,745,769 | A * | 5/1988 | Wooden, Jr. | 62/259.1 |
| 4,953,328 | A * | 9/1990 | Sewell et al. | 52/79.1 |
| 4,986,389 | A * | 1/1991 | Halligan et al. | 182/138 |
| 5,226,264 | A * | 7/1993 | Walters | 52/63 |
| 5,660,054 | A * | 8/1997 | Rice | 62/259.1 |
| 6,186,158 | B1 * | 2/2001 | Goarin | 135/128 |
| 6,430,954 | B1 * | 8/2002 | Smith | 62/259.1 |
| 6,776,178 | B1 * | 8/2004 | Glynn et al. | 135/115 |
| 7,189,349 | B2 * | 3/2007 | Karle | 422/28 |
| 7,819,151 | B1 * | 10/2010 | Kuhn | 150/154 |
| 8,137,769 | B1 * | 3/2012 | Copeland | 428/18 |
| 2005/0022853 | A1 * | 2/2005 | Scissom | 135/156 |
| 2006/0165931 | A1 * | 7/2006 | Gaulrapp et al. | 428/36.1 |
| 2008/0098663 | A1 * | 5/2008 | Seel | 52/36.1 |
| 2008/0282652 | A1 * | 11/2008 | Wardlaw | 55/385.2 |
| 2013/0161215 | A1 * | 6/2013 | Dowdy et al. | 206/320 |
| 2013/0174882 | A1 * | 7/2013 | Ellenbecker | 135/115 |

* cited by examiner

*Primary Examiner* — Noah Chandler Hawk
(74) *Attorney, Agent, or Firm* — Neugeboren O'Dowd PC

(57) ABSTRACT

An adjustable enclosure and method related to the same, with the adjustable enclosure including: a frame, one or more cables extending from one frame location to at least one other frame location, and material extending from the one or more cables, with the material covering at least a portion of one enclosure side.

15 Claims, 8 Drawing Sheets

MULTI-SEASONAL FIELD DEVICE ENCLOSURE

FIELD OF THE INVENTION

The present invention relates to enclosures. In particular, but not by way of limitation, the present invention relates to an enclosure for an oil and gas field compressor and associated equipment.

BACKGROUND OF THE INVENTION

The rapid increase in oil and gas development has created an abundance of compressor stations. Compressor stations may be comprised of a compressor adapted to compress the gas for transport, as well as "on lease" uses. These compressor stations are often located in extreme weather locations and need frequent maintenance, repair, and servicing. As such, buildings are often built around these compressor stations to help protect the compressor stations from the extreme weather. These building are expensive, difficult and time-consuming to build and operate, often requiring multiple permits before beginning construction. For example, if the building requires placement of materials within the ground, a determination must first be made and a permit obtained regarding where any underground equipment (piping, etc.) is located so as not to disturb the equipment. Furthermore, many permanent compressor buildings must be demolished or walls or roofs must be destroyed or removed in order to access the compressor and associated mechanical equipment with a crane or other construction equipment. Also, these buildings often lack proper ventilation, creating hazards for maintenance crews and equipment alike.

SUMMARY OF THE INVENTION

In order to minimize the time and cost associated with building compressor enclosures, a new and adjustable compressor enclosure was created. One adjustable enclosure comprises a frame, one or more cables extending from one frame location to at least one other frame location, and flexible material extending from the one or more cables. The flexible material comprises at least one enclosure side. Other items besides cables may be used such as, but not limited to, bars or piping. One embodiment may also comprise two or more cables.

Another embodiment of the invention comprises a method of installing a compressor enclosure. One such method comprises creating a plurality of flexible enclosure sections in a plurality of sizes, coupling an enclosure frame to an enclosure base, which may also be referred to herein as a compressor base, coupling at least one cable to the enclosure frame, and determining an amount of the plurality of flexible enclosure sections to enclose the compressor. The method may further comprise coupling the amount of the flexible enclosure sections in the plurality of sizes to the at least one or more cables and coupling each of the amount of the flexible enclosure sections to one of the frame and another of the amount of the flexible enclosure sections.

Yet another embodiment of the invention comprises a multi-seasonal enclosing system. One such system comprises a base, a compressor coupled to the base, and piping. The piping may be coupled to, and extend away from, the compressor. The system may further comprise a frame, a roof coupled to the frame, and a flexible enclosure coupled to the frame.

BRIEF DESCRIPTION OF THE DRAWINGS

Various objects and advantages and a more complete understanding of the present invention are apparent and more readily appreciated by reference to the following Detailed Description and to the appended claims when taken in conjunction with the accompanying Drawings wherein:

DETAILED DESCRIPTION

Figure 1:
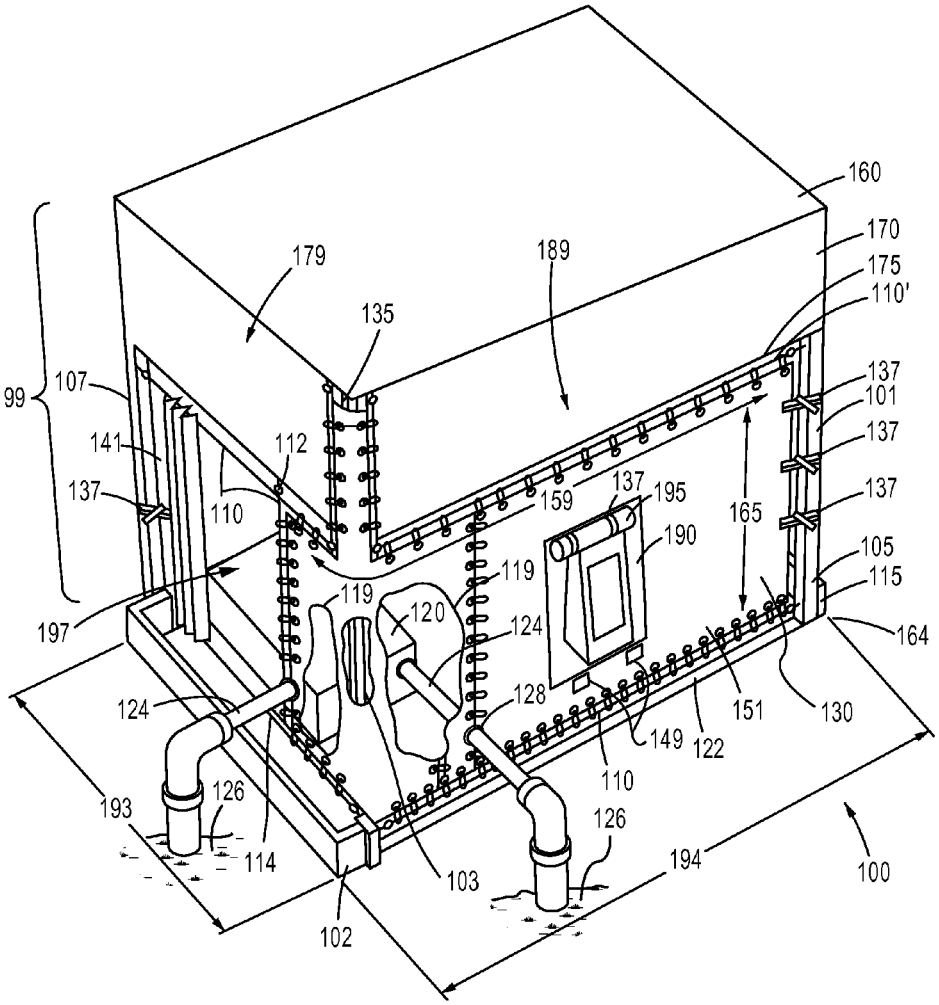
FIG. 1 depicts an enclosure according to one embodiment of the invention.

Turning first to FIG. 1, seen is one embodiment of an adjustable enclosure 100. One adjustable enclosure 100 comprises a frame 105. The enclosure 100 may further comprise one or more cables 110. The one or more cables 110 may extend from one frame location such as, but not limited to a first frame vertical post 101 to at least one other frame location, such as, but not limited to a second frame vertical post 103. Cables 110 may comprise substantially horizontal cables 110, such as the cable extending between the first vertical post 101 and second vertical post 103. Cables 110 may also comprise substantially vertical cables such as, but not limited to, the cable 110 extending from a first frame location 112 to a second frame location 114. Vertical cables may be run to close up air gaps. For example, if the enclosure comprises a gas motor, heat may wish to be maintained. If an electric motor is included, a window instead may be used to cool the motor. The frame may either couple to the base or may be placed in or on the ground. If placed on the base, there is no ground penetration and therefore there is no need to determine where pipes in the ground are located prior to installation.

Figure 2:
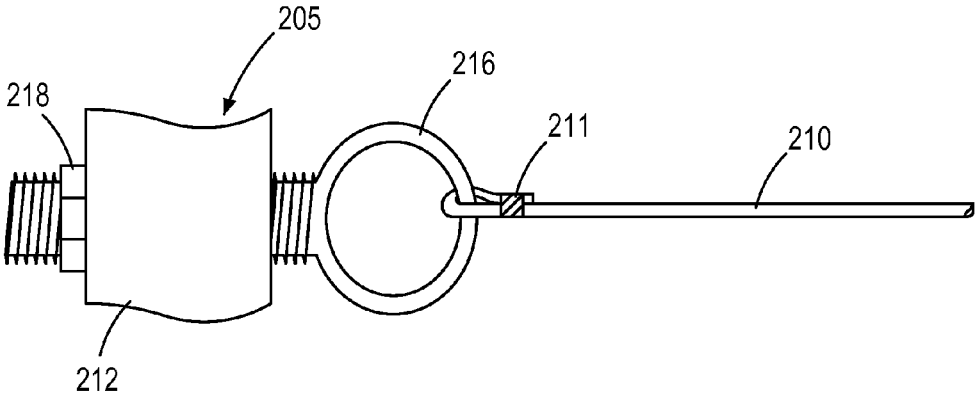
FIG. 2 depicts a cable-frame coupling mechanism according to one embodiment of the invention.

In turning now to FIG. 2, seen is a close-up of a cable 210 coupled to a frame 205. The cable 210 may be coupled to the frame 205 at the first frame location 112. However, the cable 210 may be coupled to any other frame location in a similar manner. As seen, the cable 210 may couple to an eyebolt 216 at the first frame location 212. The eyebolt 216 may instead comprise a J-bolt or any other cable-receiving device. A tightening mechanism 218 such as, but not limited to, a nut, may also be coupled to a threaded portion of the eyebolt 216 sticking through an opposing side of the frame 205 in order to make the cable 210 more taut upon tightening or providing the cable 210 more slack upon loosening. Other tightening mechanisms 218 known in the art besides a nut and threaded eyebolt 216 combination are contemplated. As seen, a clasp 211 may also be used to couple the cable 210 to the eyebolt 216. Other mechanisms known in the art of coupling cables to other objects besides clasps 211 are contemplated.

Figure 3:
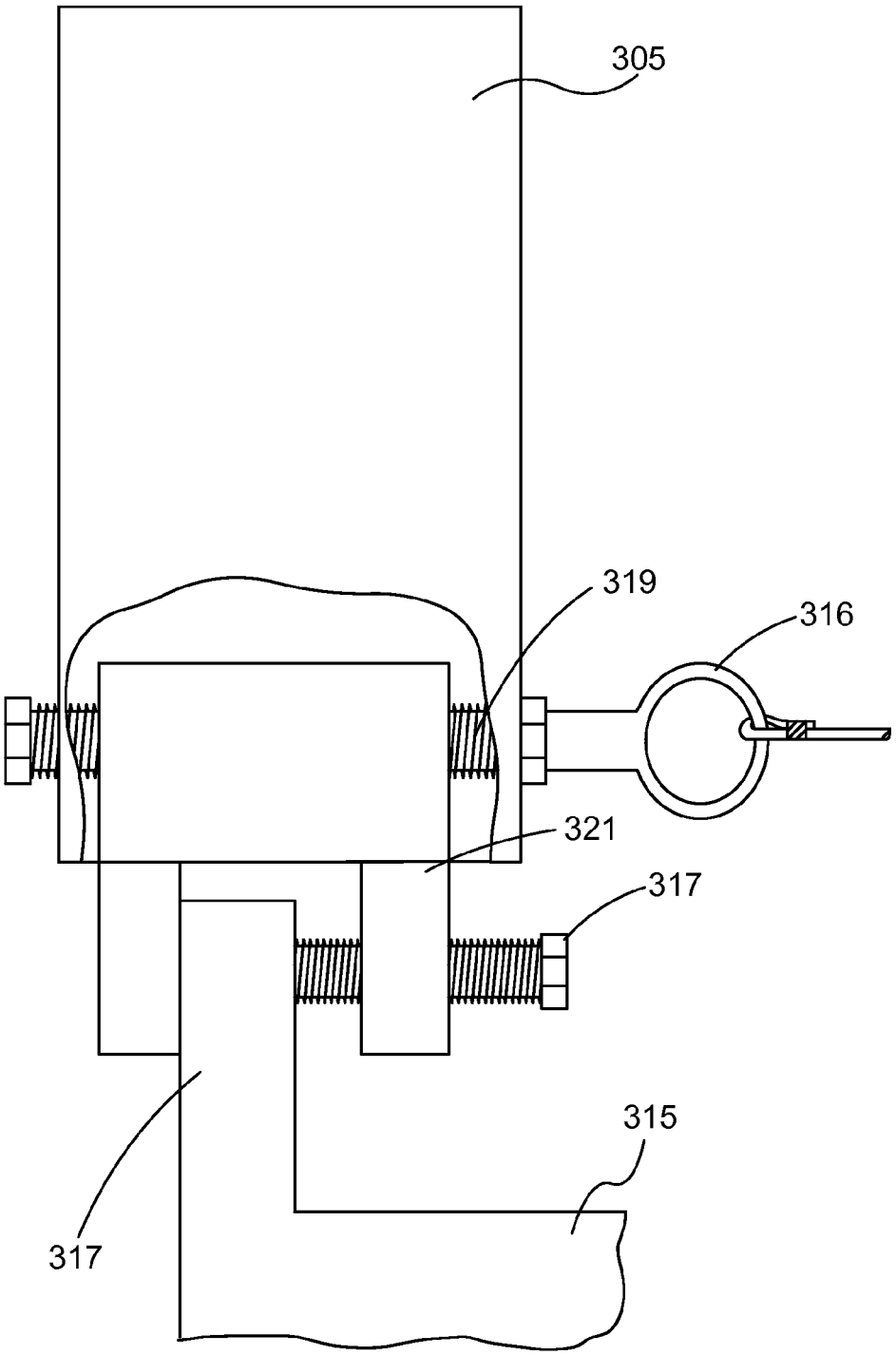
FIG. 3 depicts a frame-base coupling mechanism according to one embodiment of the invention.

Returning now to FIG. 1, seen is the frame 105 being coupled to a base 115. Turning now to FIG. 3, seen is a close-up of one frame 305 and base 315 coupling. As seen through the cutout 319 in the frame 305, a clamping device 321 such as, but not limited to, a beam-clamp may be coupled to the frame 305 and to a base flange 317. As seen, the clamping device 321 may clamp to the base 315. The frame 305 may couple to the clamping device 321 through the use of an eye bolt 316 and/or a regular bolt 317. However, other coupling mechanisms known in the art are also contemplated.

Figure 4:
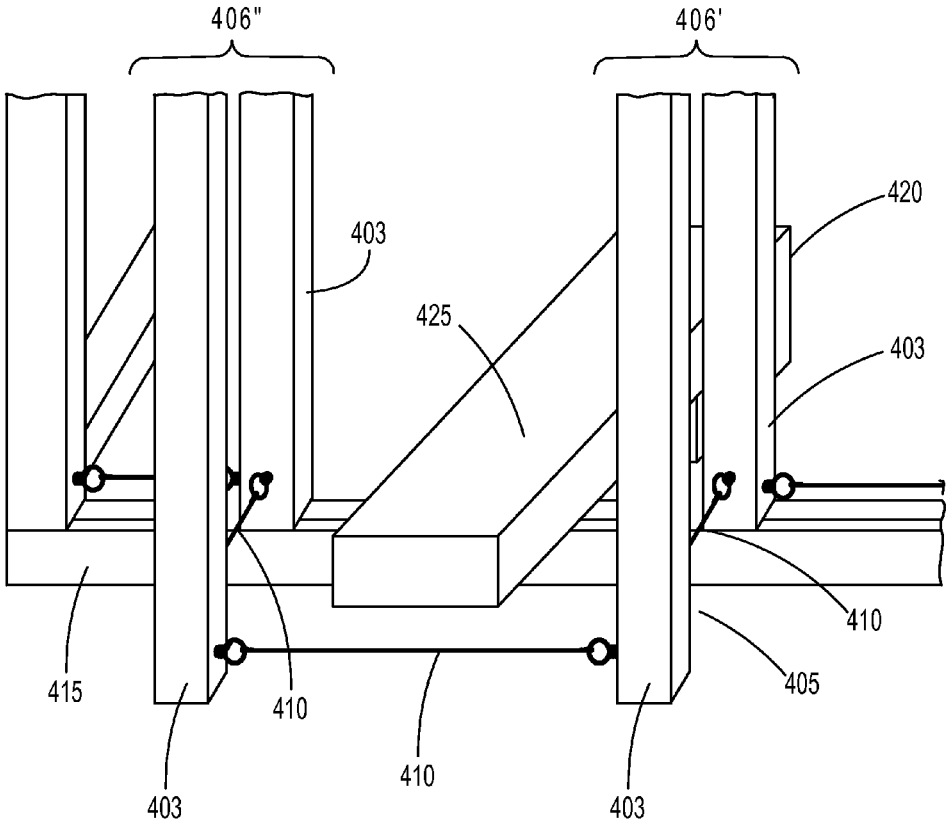
FIG. 4 depicts a frame extension according to one embodiment of the invention.

Returning now to FIG. 1, seen are the vertical posts 101, 103, 107 coupled to the corners of the base 115. However, the vertical posts 101, 103, 107 may also, or alternatively, be coupled to other base 115 locations, potentially along an outer base edge 122. It is contemplated that at least a portion of the frame 105 may also extend away from the base 115 and may not be located above the base 115. For example, seen in FIG. 4 is a portion of the frame 405 which extends away from the base 415. Such an extension may comprise a first extension 406' and a second extension 406". It is contemplated that the frame 405 may not comprise the portion of the frame 405 which extends away from the base 415. As seen, the extensions 406 may comprise one or more vertical posts 403 and cables 410. In the embodiment not comprising the portion of the frame 405 which extends away from the base 415, the vertical posts 403 may be placed in or on the ground. Such extensions 406 may be used to enable an enclosure device 420 to be protected by the flexible material 130, as seen in FIG. 1. Returning now to FIG. 4, as seen, a portion 425 of the enclosure device 420 that may extend outwardly and away from the base 415 may not be located above the base 415. As such, the flexible material 130 seen in FIG. 1 may not protect the portion 425. In order for the portion 425 to be protected, the extensions 406 may be used.

Returning now to FIG. 1, seen is the flexible material 130 extending between the cables 110. Only three sides to the enclosure 100 may comprise the flexible material, in order to make room for compressor parts (e.g. a cooler). In looking at FIG. 5, seen is a close-up of the flexible material 530 and a cable 510 coupling mechanism. In one embodiment, the flexible material 530 may couple to the cable 510 through a metal loop and spring-loaded gate, also known in the art as a spring clip or carabiner 540. The carabiner 540 may hook around the cable 510 and may be placed through a hole 550 in the flexible material 530. Surrounding the hole 550 may be a grommet 552.

Figure 5:
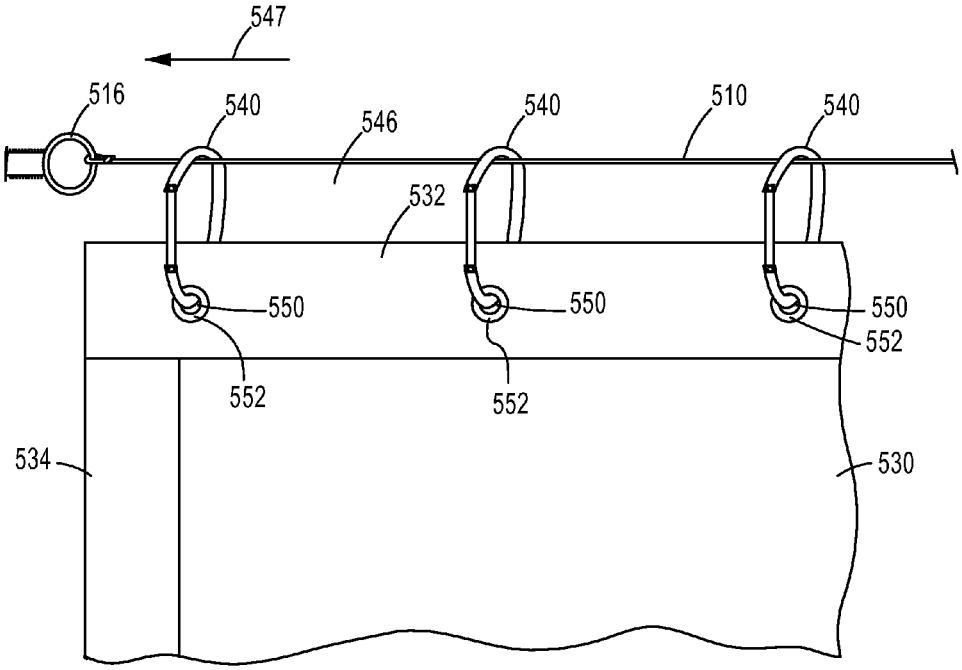
FIG. 5 depicts a cable-flexible material coupling mechanism according to one embodiment of the invention.

As also seen in FIG. 5, the flexible material 530 may comprise a first flexible material. The first flexible material may comprise a flame/fire-resistant (FR) and ultraviolet (UV) light protectant polymeric material. The material 530 may comprise at least one of a PVC coated fabric in one embodiment. Such FR and UV materials may comprise a polymeric fabric having an FR and/or a UV-coating. An upper border 532 and side border 534 may be coupled to the flexible material at or near a flexible material edge. The upper border 532 may comprise a second flexible material and the side border 534 may comprise a third flexible material. The second and third flexible material may be stiffer and/or heavier than the first flexible material, in order to provide the flexible material 530 with additional weight and/or ensure the flexible material more easily retains its shape (e.g., square, rectangular, etc.) than without the borders 532, 534, for example, in adverse weather conditions. The first and second flexible material may comprise a nylon material and in one embodiment may comprise material substantially similar to a vehicle seat-belt.

In returning now to FIG. 1, as seen, at least a portion of the flexible material 130 may extend to a location proximal an enclosure roof 160. For example, a corner section 135 may extend to the roof 160. In other sections, the flexible material may extend to a location proximal a lower edge 175 of a roof barrier 170. The roof barrier may comprise a one-fourth of a length 99 of an enclosure side. The side patent may comprise other portions of the enclosure side as well. For example, an entire length 99 of at least one side of an enclosure 100 may comprise a side panel or none of the length 99 may comprise the side panel 170. The side panel 170 and roof 160 may also couple to the frame 105 through one or more not-bolt coupling mechanisms. For example, the frame 105 may comprise beams which the roof 160 and side panels 170 couple to the side panel 170 and roof may comprise substantially rigid and non-flexible material such as, but not limited to a metal material like aluminum or steel.

Figure 6:
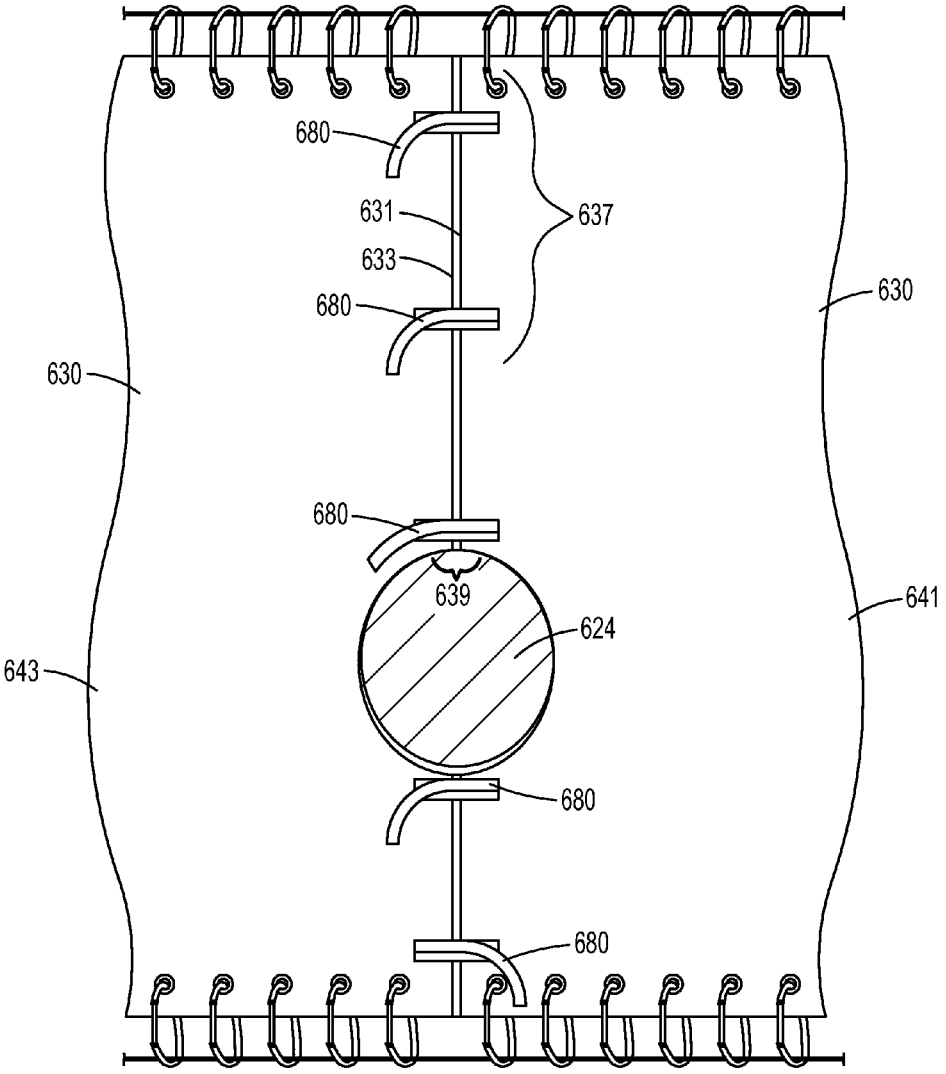
FIG. 6 depicts using two or more flexible material sections to allow an attachment to exit an interior of an enclosure according to one embodiment of the invention.

As seen through the cutouts 119 in FIG. 1, one or more enclosure device 120 may be coupled to the base 115. One such enclosure device 120 may comprise a compressor. Additionally, one or more device attachments 124 may be coupled to the device 120. One such attachment 124 may comprise piping. For example, the piping may extend away from the device 120 and into the ground 126. It is contemplated that with any attachment 124 extending outside of a plane between the cables 110, vertical posts 103, horizontal frame posts and/or the base edge 122 and an upper horizontal frame post, two tarps may meet at the protruding piping. For example, as seen in FIG. 6 is an example of fitting flexible material 630 around an attachment 624. The space between the two flexible material sections may be referred to herein as "joints." As seen, a first flexible material section edge 631 may be placed proximal a second flexible material section edge 633 at or near the attachment 624. For example, an upper portion 637 of the first flexible material section edge 631 may be placed proximal an upper portion 637 second flexible material section edge 633 generally above a center 639 of the attachment 624. Upon placing the edges 631, 633 proximal each other, strapping 680 coupled to the first flexible material section 641 and second flexible material section 643 may couple the first flexible material section 641 to the second flexible material section 643. The strapping 680 may include buckles or other clasping mechanisms known in the art. Near the attachment 624, the first flexible material section 641 and the second flexible material section 643 may be stretched around the attachment 624.

Returning now to FIG. 1, seen is a window 190. The window 190 may comprise a bore, or "hole," in the flexible material 130. Coupled to the flexible material 130 near the window 190 may be a window shade 195. Strapping 137 may be coupled to the shade 195 and/or the flexible material near the shade 195. The strapping 137 may be adapted to keep the shade 195 in an open position, as seen in FIG. 1. The strapping 137 may also couple to one or more additional strapping sections 149 such as, but not limited to, clasping mechanisms, to keep the shade 195 in a closed position. A plurality of windows may be located on one or more flexible material sections. When in the open position, the windows 190 may create airflow through the interior 197 of the enclosure 100. Such airflow may decrease the temperature in the interior 197 of the enclosure 100. The airflow may also be created and/or the temperature may be decreased through opening the flexible material from a first position to a second position. For example, the first flexible material 141 may be seen in FIG. 1 in the second position and coupled to the frame 105. Additional sections of flexible material 130 may also be opened in a similar manner. The second flexible material 151 in FIG. 1 is shown in the first, closed, position. It is also contemplated that an enclosure 100 may further comprise additional strapping 137 which may couple to a vertical post 103 and wrap around an open flexible material, as seen with the first flexible material 141.

In one embodiment, the flexible material 130 may comprise at least a portion of one enclosure side. For example, the flexible material 130 may comprise a portion of a first enclosure side 189 and a second enclosure side 179 seen in FIG. 1. One or more sections of flexible material 130 may cover the one or more sides. As seen in FIG. 1, the first flexible material 141 covers a portion of the second enclosure side and a second flexible material 151 covers a portion of the first enclosure side 189 and second enclosure side 179. It is contemplated that each flexible material section may comprise one or more adjustable heights 169 and lengths 159. The length 159 of the second flexible material 151 wraps around two sides, though a flexible material section length 159 may only cover one side or a portion of one side. It is contemplated that the heights 169 and the lengths 159 of the flexible material may be adjusted through the use of strapping 137 and cable 110 placement to create or minimize openings in the walls of the enclosures. Any number of sizes is contemplated. Such openings, or lack thereof, in combination with the heat generated by the devices 120 may be adapted to create an interior 197 enclosure temperature of about 60-80 degrees Fahrenheit and may also enable gas emitted from the interior 197 of the enclosure to escape to outside the enclosure 100. For example, exhaust gas may be emitted through one or more devices 120 in the enclosure 100. Even with all the flexible material 130 in a closed position, there may be a gap 546 between the cables 510 and the flexible material 530, as seen in FIG. 5, allowing the gas to escape the interior 197, as seen in FIG. 1. The gap 546 may be located proximal any cable 110 and flexible material coupling seen in FIG. 1. Furthermore, the gap 546 may be increased or decreased by the size of the carabiner 540 or other locking mechanism, the thickness of the cable 510, and/or the placement of the holes 550 in the flexible material 530. With ventilation at the bottom of, between, and at the top of the side panels and the flexible material, gas may escape, so the enclosures 100 are safer than prior art enclosures.

Figure 7:
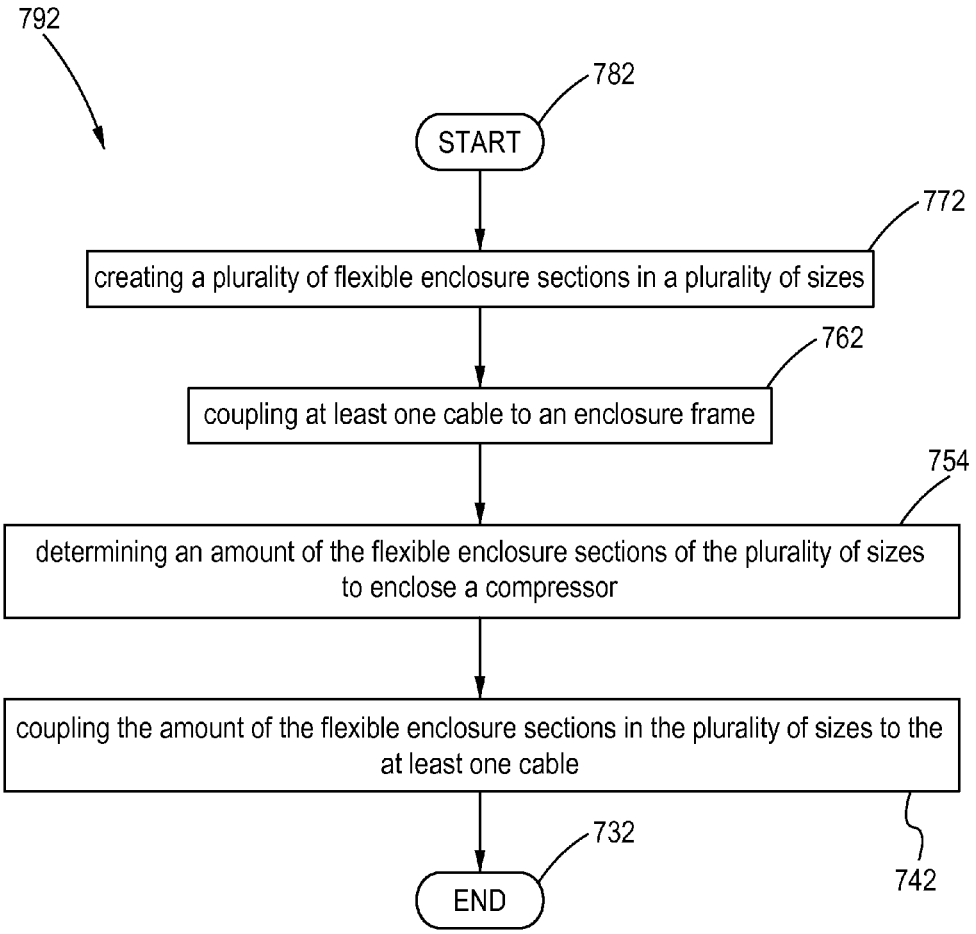
FIG. 7 depicts a method that may be carried out with any of the embodiments disclosed herein.
Figure 8:
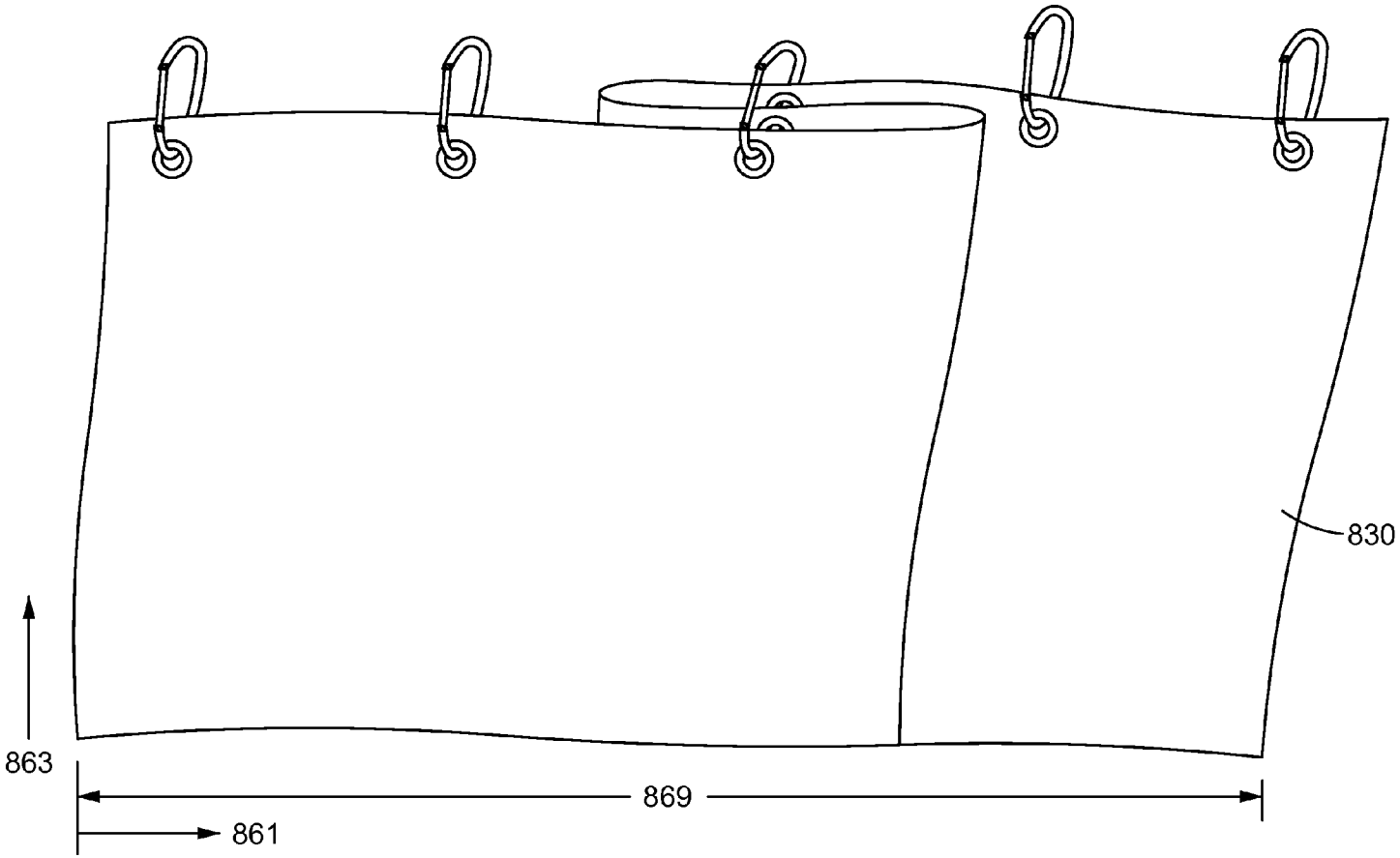
FIG. 8 depicts a section of flexible material according to one embodiment of the invention.

Turning now to FIG. 7, seen is a method 792 of installing a compressor enclosure such as, but not limited to, the compressor enclosure 100 seen in FIG. 1 and described herein. The method 792 starts at 782 and at 772 comprises creating a plurality of flexible enclosure sections in a plurality of sizes. For example, it is contemplated that in order to save costs by quickly building a plurality of enclosures 100, it may be desired to erect as many enclosures or portions of enclosures in a day as possible when an order has been placed for building multiple enclosures 100. In one such scenario, the base 115, device 120 and attachments 124 may be already built, but specifications related to the base, device and attachments (e.g., length 194 and width 193 of the base 115, location of the attachments 124 and devices 120, etc.) may be unknown prior to arriving at the site for erection of the enclosure 100. Therefore, an installer may desire to have a plurality of varying size flexible material sections on-hand, prior to arriving at the site to ensure the enclosure 100 may be erected properly. Alternatively, or additionally, a section of flexible material 830, such as the one seen in FIG. 8, may comprise one or more length-wise 861 and/or height-wise 863 folds, with a length-wise 861 fold seen in FIG. 8. Such folds may enable a length 869 of the material 130 to be adjusted to a desired length 869.

Upon obtaining the proper number and dimensions of material 130, and as seen at step 762 and described above, the method 792 may comprise coupling at least one cable 110 to an enclosure frame 105. At 754 the method 792 comprises determining an amount of the flexible enclosure sections of the plurality of sizes to enclose a compressor. This may comprise measuring the dimensions of the base 115 and a desired/required height of the enclosure 100 and selecting the sections of flexible material which will enable the enclosure 100 to be created. At this point, and as seen at step 742, the selected flexible enclosure sections are coupled to at least one cable 110. The method ends at step 732.

It is contemplated that at least a portion of each of the plurality of sizes of material 130 may comprise a substantially similar heights and different lengths. Furthermore, coupling the amount of the flexible enclosure sections in the plurality of sizes to the at least one cable 110 may comprise coupling a plurality of flexible enclosure sections to one or more upper cables such as, but not limited to the upper cable 110' seen in FIG. 1. Additionally, coupling the amount of the flexible enclosure sections in the plurality of sizes to the at least one cable 110 may comprise coupling at least one removable coupling mechanism such as, but not limited to, the carabiner 540, to the amount of the flexible enclosure sections and coupling the at least removable coupling mechanism to the at least one cable 110. One method 792 may further comprise coupling a first flexible enclosure section such as, but not limited to the first flexible material section 641 to a second flexible enclosure section such as, but not limited to the second flexible material section 643, with an adjustable coupling mechanism. One adjustable coupling mechanism may comprise the strapping 137.

It is further contemplated that a method 792 may comprise creating an opening in the enclosure 100. One such opening may be created by moving a section of the flexible material 130. For example, a position of the removable coupling mechanism from a first location to a second location. One first location may comprise the first position that the second flexible material 151 in FIG. 1 is shown, which may comprise a closed position. One second location may comprise the location that the first flexible material 141 may be seen in FIG. 1, which may comprise an open position. Moving the flexible material between positions may comprise modifying the adjustable coupling mechanism. For example, the strapping 137 may be adjusted to couple a section of flexible material 130 to a post 101 or to another section of flexible material 130. Upon creating an opening, maintenance may be performed on a device 120 or attachment 124 or parts may be replaced on the device 120 or attachment 124.

In order to create the opening, the at least one removable coupling mechanism such, as the carabiners 540 seen in FIG. 5 may slide along the at least one cable 510 to create an opening. For example, the carabiners may slide in the first direction 547, coming to rest proximal to an eyebolt 516. As stated previously, the at least one removable coupling mechanism may comprise a metal loop and a spring-loaded gate and the adjustable coupling mechanism may comprise flexible strapping and one or more fasteners (e.g., buckles).

In changing the flexible material 130 from a first position to a second position, air may start to flow from a first frame side 162 to a second frame side 164, and the temperature inside the enclosure may be decreased. For example, without ventilation, internal enclosure temperature may reach 140 degrees Fahrenheit or higher. Also, when the flexible material 130 is in the first position, the volume of the sound emitted from the device 120 may be quieter on the outside of the enclosure 100 and the temperature in the enclosure may be increased.

One method 792 may further comprise transporting the flexible enclosure sections, at least one cable, removable coupling mechanism, and adjustable coupling mechanism to the enclosure frame 105 prior to coupling the at least one cable 110 to the enclosure frame 105. The volume of the flexible enclosure sections is less than one percent of the volume of an enclosed area. Further method steps may comprise removing the flexible enclosure sections after coupling the amount of the flexible enclosure sections in the plurality of sizes to the at least one cable 100.

It is further contemplated that one embodiment of the invention may be referred to as an enclosing system. One enclosing system may comprise the enclosure 100 seen in FIG. 1. Like the enclosure 110 in FIG. 1, the enclosing system may comprise the base 115, a compressor or other device 120 coupled to the base and piping or other attachments 124. The piping may be coupled to the compressor and may extend away from the compressor. The enclosing system may further comprise the frame 105, a roof 160 coupled to the frame and a flexible enclosure coupled to the frame 105. The flexible enclosure may comprise, for example, the flexible material, 130, cables 110, strapping and carabiners or other devices.

As with the enclosure 100, in the enclosing system, one or more sections of the piping may extend beyond a plane extending between outer frame surface. In such a case, one or more sections of the flexible enclosure may be placed around the one or more sections of the piping, as shown in FIG. 6.

It is further contemplated that the base 115 may comprise at least one base edge 122 and that at least a portion of the frame 110 and/or at least a portion of the piping may be located outside of a vertical plane extending upwardly from the at least one base edge 122. The flexible enclosure may comprise an outer surface comprising one or more second bore sections such as, but not limited to, a window 190. The one or more second bore sections may comprise one or more second bore section sizes and one or more second bore section shapes. At least one flap (e.g., the shade 195) may be coupled to the outer surface. The at least one flap may comprise at least one flap size, and at least one flap shape. The at least one flap size and the at least one flap shape may be substantially similar to the one or more second bore section sizes and the one or more second bore section shapes. One or more adjustable coupling mechanisms such as, but not limited to, the strapping, may also be coupled to the outer surface and/or the at least one flap. The one or more adjustable coupling mechanisms comprise strapping adapted to change the at least one flap from a closed position to an open position.

The installation time of an enclosure 100 may comprise about a half a day or approximately 6-8 hours for units from about 6'×10' to about 9'×20'. The installation time of a larger enclosure 100 may comprise about a day and a half, or approximately 15-20 hours for units from about 12×20' to about 16×35'. The time to tear-down an enclosure 100 may be less than 4 hours. Sizes of the enclosures can be adapted to any size compressor. Enclosures 100 may also comprise braces 129 which may be removable/relocatable to obtain access to maintain/repair the device 120. Panels may also be installed before flexible material.

Those skilled in the art can readily recognize that numerous variations and substitutions may be made in the invention, its use and its configuration to achieve substantially the same results as achieved by the embodiments described herein. Accordingly, there is no intention to limit the invention to the disclosed exemplary forms. Many variations, modifications and alternative constructions fall within the scope and spirit of the disclosed invention as expressed in the claims.

What is claimed is:

1. An adjustable enclosure comprising,
a base comprising at least one base edge;
a compressor coupled to the base;
a frame coupled to the base, wherein:
the frame comprises an outer frame surface, and
at least a portion of the frame extends outside of a vertical plane extending away from the at least one base edge;
a roof coupled to the frame;
customer-supplied piping, wherein one or more sections of the piping:
is coupled to the compressor, and
extends:
beyond the outer frame surface,
away from the compressor, and
outside of the vertical plane;
one or more cables extending from one frame location to at least one other frame location;
one or more sections of flexible material extending:
from the one or more cables, and
around the one or more sections of piping, wherein, the material comprises:
at least one flap, the at least one flap having at least one:
size, and
shape,
at least one enclosure side,
an outer surface comprising one or more bore sections, the one or more bore sections comprising one or more:
sizes, and
shapes, wherein:
the one or more second bore section sizes and shapes are generally similar to the at least one flap size and shape;
one or more adjustable coupling mechanisms adapted to change the at least one flap from a closed position to an open position, wherein, the one or more adjustable coupling mechanisms are coupled to the:
one or more sections of flexible material, and
at least one flap; and
one or more joints between the one or more sections of flexible material, the one or more joints accommodating the one or more sections of the piping.

2. The enclosure of claim 1 wherein,
the one or more sections of flexible material comprise:
one or more heights, and
one or more lengths.

3. The enclosure of claim 2 wherein, the one or more heights and the one or more lengths are adjustable to enable:
an enclosure temperature to be adjustable by an operator of the enclosure; and
gas emitted from inside the enclosure to escape to outside the at least one enclosure side.

4. The enclosure of claim 1 wherein, the one or more sections of flexible material comprises at least one of a:
flame-resistant material; and
a pvc-coated nylon fabric.

5. The enclosure of claim 1 wherein,
the frame further comprises at least one corner post; and
the at least one enclosure side is:
adapted to change from a first position to a second position, and
coupled to the at least one corner post in the first position.

6. A method of installing a compressor enclosure comprising,
creating a plurality of flexible enclosure sections in a plurality of sizes, wherein the plurality of flexible enclosure sections comprise:

at least one flap, the at least flap having at least one:
size, and
shape,
an outer surface comprising one or more bore sections, the one or more bore sections comprising one or more:
sizes, and
shapes, wherein the one or more bore sections sizes and shapes are substantially similar to the at least one flap size and shape;
coupling one or more straps to the:
plurality of flexible enclosure sections, and
at least one flap;
coupling an enclosure frame to an enclosure base, wherein the:
enclosure base comprises at least one base edge, and
at least a portion of the frame extends outside of a vertical plane extending away from the at least one base edge;
coupling a compressor to the enclosure base;
coupling at least one cable to the enclosure frame;
coupling a roof to the enclosure frame;
coupling one or more sections of customer-supplied piping to the compressor, wherein, the one or more sections of customer-supplied piping extend:
beyond an outer frame surface,
away from the compressor, and
outside the vertical plane;
accommodating the one or more sections of customer-supplied piping between one or more joints in the plurality of flexible enclosure sections;
determining an amount of the plurality of flexible enclosure sections to enclose:
the compressor; and
one or more sections of customer-supplied piping located interior to the:
outer frame surface, and
vertical plane;
coupling the amount of the flexible enclosure sections in the plurality of sizes to the at least one cable;
coupling each of the amount of the flexible enclosure sections to one of,
the frame, and
another of the amount of the flexible enclosure sections; and
using the one or more straps to change the at least one flap from a closed position to an open position.

7. The method of claim 6 wherein,
each of the plurality of flexible enclosure section sizes comprises:
a substantially similar height; and
different lengths; and
coupling the amount of the flexible enclosure sections to the at least one cable comprises coupling a plurality of flexible enclosure sections to:
one or more upper cables, and
one or more lower cables.

8. The method of claim 6 wherein,
coupling the amount of the flexible enclosure sections in the plurality of sizes to the at least one cable comprises,
coupling at least one removable coupling mechanism to the amount of the flexible enclosure sections, and
coupling the at least removable coupling mechanism to the at least one cable; and further comprising,
coupling a first flexible enclosure section to a second flexible enclosure section with at least one of the one or more straps.

9. The method of claim 8, further comprising,
creating an opening in the enclosure by one of,
changing a position of the removable coupling mechanism from a first location to a second location, and
modifying the one or more straps; and
at least one of,
performing maintenance on one of a compressor and piping, and
replacing one or parts related to the one of the compressor and piping.

10. The method of claim 8 further comprising, sliding the at least one removable coupling mechanism along the at least one cable to create an opening; and wherein,
the at least one removable coupling mechanism comprises,
a metal loop, and
a spring-loaded gate; and
the one or more straps comprise flexible strapping and one or more fasteners.

11. The method of claim 6 further comprising,
changing the flexible material from a first position to a second position, wherein,
the enclosure frame comprises a first frame side and a second frame side,
the first position comprises an open position, and
the second position comprises a closed position;
enabling airflow from the first frame side to the second frame side when in the open position; and
increasing the temperature in the enclosure when in the closed position.

12. The method of claim 6 further comprising,
transporting the:
flexible enclosure sections,
at least one cable,
removable coupling mechanism, and
one or more straps to the enclosure frame prior to coupling the enclosure frame to the enclosure base; and
removing the flexible enclosure sections after coupling the flexible enclosure sections in the plurality of sizes to the at least one cable.

13. The method of claim 6 further comprising, extending at least one of the plurality of flexible enclosure sections at least partially around an attachment extending outside of the enclosure.

14. A multi-seasonal enclosing system comprising,
a base comprising at least one base edge;
a compressor coupled to the base;
customer supplied piping, wherein:
the piping is coupled to the compressor and one or more sections of the piping extend:
away from the compressor,
beyond an outer frame surface, and
outside of a vertical plane extending away from the at least one base edge;
a frame;
a roof coupled to the frame; and
a flexible enclosure coupled to the frame, wherein:
the flexible enclosure comprises:
an outer surface comprising one or more bore sections, the one or more bore sections having one or more:
sizes, and
shapes;
at least one flap coupled to the outer surface, the at least one flap having at least one:
size, and
shape, at least one of:

one or more sections of the flexible enclosure are placed around the one or more sections of the piping, and one of more joints between flexible enclosure sections accommodate the one or more section of the piping the at least one flap size and shape is generally similar to the one or more second bore section sizes and shapes; and one or more adjustable coupling mechanisms comprising one of strapping and hook-and-loop material are coupled to the outer surface and the at least one flap, the one of strapping and hook-and-loop material being adapted to change the at least one flap from a closed position to an open position.

15. The enclosure system of claim 14 wherein, the flexible enclosure comprises, a length, and a height;

at least one of the length and the height is adapted to be adjusted to accommodate for at least one of, maintaining the compressor, and modifying the temperature of the enclosure.

* * * * *